US008469080B2

(12) United States Patent
Shan et al.

(10) Patent No.: US 8,469,080 B2
(45) Date of Patent: Jun. 25, 2013

(54) DIGITAL PROCESSING METHOD AND DEVICE OF LARGE OR MEDIUM-SIZE SAND MOLD

(75) Inventors: Zhongde Shan, Beijing (CN); Xinya Li, Beijing (CN); Feng Liu, Beijing (CN); Li Zhan, Beijing (CN); Xiaoli Dong, Beijing (CN); Xianglei Wang, Beijing (CN)

(73) Assignee: Advanced Manufacture Technology Center China Academy of Machinery Science and Technology, Beijing (CN)

( * ) Notice: Subject to any disclaimer, the term of this patent is extended or adjusted under 35 U.S.C. 154(b) by 221 days.

(21) Appl. No.: 13/132,590

(22) PCT Filed: Nov. 25, 2009

(86) PCT No.: PCT/CN2009/075126

§ 371 (c)(1),
(2), (4) Date: Jun. 2, 2011

(87) PCT Pub. No.: WO2010/075716

PCT Pub. Date: Jul. 8, 2010

(65) Prior Publication Data

US 2011/0230993 A1 Sep. 22, 2011

(30) Foreign Application Priority Data

Dec. 30, 2008 (CN) ..... 2008 1 0246752

(51) Int. Cl.

| | |
|---|---|
| ***B22C 9/00*** | (2006.01) |
| ***B22D 29/00*** | (2006.01) |
| ***G06F 19/00*** | (2011.01) |

(52) U.S. Cl.

USPC ..... 164/17; 164/69.1; 164/349; 700/98; 700/146; 700/173; 700/182

(58) Field of Classification Search

USPC ..... 700/95–98, 145, 146, 159, 173, 180, 700/182; 164/17, 47, 69.1, 349

See application file for complete search history.

(56) References Cited

U.S. PATENT DOCUMENTS 6,286,581 B1 * 9/2001 Gustafson ..... 164/17

FOREIGN PATENT DOCUMENTS

| | | | | |
|---|---|---|---|---|
| CN | 101259736 | A | | 9/2008 |
| CN | 101279357 | A | | 10/2008 |
| CN | 101372135 | A | * | 2/2009 |
| CN | 101444828 | A | | 6/2009 |
| JP | 53-58432 | | | 5/1978 |
| JP | 55084269 | A | * | 6/1980 |
| JP | 55160745 (U) | | | 11/1980 |
| JP | 61-176440 | | | 8/1986 |
| JP | 63-052789 | | | 3/1988 |
| JP | 63-300845 | | | 12/1988 |
| JP | 01-164535 | | | 6/1989 |
| JP | 03-188815 | | | 8/1991 |
| JP | 07-040189 | | | 2/1995 |

(Continued)

*Primary Examiner* — Crystal J Barnes-Bullock

(74) *Attorney, Agent, or Firm* — Patterson Thuente Pedersen P.A.

(57) ABSTRACT

A digital processing method of a large or medium-size sand mold includes inverting a three-dimensional CAD model of a mold into a numeric controlling code, putting a prepared sand blank on a hollow grid-shaped processing platform to proceed the digital milling procedure, bringing away waste sand generated during processing by high pressure gas blown out from a nozzle near a cutter and the waste sand entering to a collecting device below the processing platform. A device for carrying out the method is disclosed. The method and the device reduce the processing steps.

10 Claims, 2 Drawing Sheets

FOREIGN PATENT DOCUMENTS

| | | | |
|---|---|---|---|
| JP | 09-150237 | | 6/1997 |
| JP | 2000-061755 | | 2/2000 |
| JP | 2000-351044 | | 12/2000 |
| JP | 2002-066993 | | 3/2002 |
| JP | 2002-120042 | | 4/2002 |
| JP | 2003-019542 | | 1/2003 |
| JP | 2004223547 | A * | 8/2004 |

* cited by examiner

DIGITAL PROCESSING METHOD AND DEVICE OF LARGE OR MEDIUM-SIZE SAND MOLD

The present application is a National Phase entry of PCT Application No. PCT/CN2009/075126, filed Nov. 25, 2009, which claims benefit of the priority to Chinese Patent application No. 200810246752.0 titled "DIGITAL PROCESSING METHOD AND DEVICE OF LARGE OR MEDIUM-SIZE SAND MOLD", filed with the Chinese State Intellectual Property Office on Dec. 30, 2008. The entire disclosures thereof are incorporated herein by reference.

FIELD OF THE INVENTION

The present invention relates to a digital processing method and a device of large or medium-size sand mold, and pertains to a cross technical field of the casting and the numerical control processing.

BACKGROUND OF THE INVENTION

Complex parts may be manufactured by casting. The casting is a main processing method for metal forming With the progress of market globalization and intense competition and the acceleration of renewal of products, there is an increasing demand for single-piece production and small-scale production of casting parts. Especially, for the sand mold manufacture process of large casting parts, it is required to have a short production cycle and a low manufacture cost. However, most manufacturers in china still adopt conventional wooden mold foundry technique which has a long manufacture cycle, a high production cost and a large consumption of natural resources. In order to solve the problem, a digital processing method and a device of large or medium-size sand mold are proposed.

At present, there are three product modes for casting mold, i.e., conventional sand mold manufacture, rapid forming sand mold manufacture and sand mold processing based on ordinary numerical control machines. For the conventional sand mold manufacture, it is necessary to manufacture a wooden mold according to a casting part, and then perform a sand box foundry to obtain a casting sand mold. The rapid forming sand mold manufacture is applied based on a dispersed-accumulated forming principle, and its basic process includes the steps of: firstly forming a series of layers by delaminating a numerical model of a sand mold in a Z-direction; and then selectively spraying binding agent or perform a laser sintering once one layer of molding sand is paved according to the profile information of layers; and forming three-dimensional sand mold by stacking layer by layer. The sand mold processing based on ordinary numerical control machines uses a numerical machine to numerically cut a sand block according to NC programming and finally obtains a sand mold.

The conventional wooden mold sand mold manufacture is suitable for mass production of casting parts. However, since the wooden mold processing has a long cycle, a high cost, and it is difficult to manufacture a casting mold having a high precision and a good surface quality, it cannot meet the processing requirements of single-piece production and small-scale production. The sand mold manufactured by the rapid forming technique has the following disadvantages. Since the sand mold is processed layer by layer, the processing efficiency is low, which is not suitable for the processing of large casting mold. Sand grains are cohered together by binding agents or laser sintering to form a casting mold having a close-grained inner surface, which has a poor gas permeability such that it is prone to cause defects in casting parts. In addition, since the sand mold is processed layer by layer, step effect would be presented when processing some complex surfaces. The ordinary numerical machine used to perform cutting of sand mold has the following disadvantages. A large amount of waste sand is produced during sand mold cutting processing, which is needed to be cleaned in time. However, the ordinary machine does not include the equipment for cleaning sand. For large casting parts, it is necessary to use a large numerical control processing machine, which increases the cost of equipment. Also, fly sand is produced during the cutting process, precise moving components of the ordinary machine such as guiding rails and leading screws, which are disposed below or near the sand blank being processed, are needed to be protected carefully.

SUMMARY OF THE INVENTION

In view of disadvantages of casting manufacture technology in the prior art, the present invention provides a digital processing method and a device of large or medium-size sand mold, which adopt more advanced, more flexible means to manufacture sand mold for casting parts having various shapes without using dies, so as to broaden processing scope, shorten production cycle, and solve the problem of cleaning waste sand when casting mold is cut by the ordinary numerical control machine. Especially, the digital processing method and the device of large or medium-size sand mold according to the present invention is applicable to sand mold manufacture of large or medium-size casting parts in the single-piece production and small-scale production.

The present invention provides a digital processing method of large or medium-size sand mold. The method includes the steps of:

a) selecting a processing cutter and designing a cutter path according to a three-dimensional CAD model of a casting mold;

b) deleting short lines with little distance in a processing path by a path optimization according to size and precision requirement of part to be processed;

c) generating processing codes acceptable to a processing equipment according to the designed path and processing parameters;

d) selecting appropriate molding sand and binding agent according to casting technique requirement so as to manufacture sand blank used in a numerical control processing;

e) placing the sand blank on a hollow grid-shaped processing platform to proceed a digital milling processing;

f) taking away waste sand generated during processing by high pressure gas blown out from a nozzle near a cutter head, and allowing the waste sand to enter into a collecting device below the processing platform through meshes of the processing platform; and g) performing a post processing to the finished sand mold.

Preferably, the design of the cutter path means that the processing of large sand molds includes two procedures, i.e., rough processing and finish processing. In the rough processing, an end milling cutter having a diameter larger than 8 mm is selected to perform cutting while giving priority to layers, with a processing allowance being ranged from 0.5 mm to 2 mm and the thickness of layer being ranged from 1 mm to 4 mm. In the finish processing, a ball end cutter having a diameter less than 8 mm is selected to perform processing of contour and curved surface while giving priority to depth, with the thickness of layer being less than 0.5 mm.

Preferably, path optimization refers to delete short lines with the length less than 1-2 mm and major arcs with the distance between its end points less than 1-2 mm by combining paths according to the size of a part to be machined and an acceptable precision;

Preferably, the processing parameters include rotation speed of a spindle, cutting velocity and cutting depth. The rotation speed of the spindle is in a range of 2000-20000 RPM, and the cutting velocity is within 200 mm/s, and the cutting depth is within 10 mm.

Preferably, the sand blank may be a sand blank with box, or may be a sand blank without box, and the size of the sand blank is larger than 350×400×100 $mm^3$. According to the requirements of casting technique, the sand blank used may be resin sand, sodium silicate sand, or also may be coated sand. Taking sodium silicate sand as an example, molding sand having various mesh number, such as 50/100, 70/140, 40/70, is selected according to type and size of casting part, binding agent is ester hardening sodium silicate, and a curing agent is organic ester curing agent.

Preferably, in the step of placing the sand blank on the hollow grid-shaped processing platform to proceed the digital milling processing, depending on weight of the sand blank and amount of cutting force, the sand blank is placed on the processing platform to be processed directly, or to be processed after being fixed by a clamping tool. The force for cutting the sand mold is generally less than 100 N, so the sand blank having a weight above 20 kg may be directly placed on the platform to be processed without being clamped.

The present invention also provides a device for carrying out the above method. The device includes a hollow grid-shaped processing platform, a waste sand collecting device provided below the processing platform and sealed with the processing platform into one piece, a X-shaft fixed above a device body, a sliding block being slidable on the X-shaft in an X direction, a Y-shaft fixed on the X-shaft sliding block, a sliding block being slidable on the Y-shaft in a Y direction, a Z-shaft fixed on the Y-shaft sliding block, a sliding block being slidable on the Z-shaft in a Z direction, an electric spindle fixed on the sliding block, a cutter clamped on the electric spindle, a nozzle fixed on the Z-shaft and disposed near the cutter head, a gas pipe connected with the nozzle, an electromagnetic valve connected with the gas pipe and controlling gas to switch on/off and a gas source connected with the electromagnetic valve via the gas pipe.

Preferably, the processing platform may include location holes for mounting a clamping tool. There is a waste sand collecting device below the processing platform, and small wheels are installed on the waste sand collecting device so as to discharge waste sand conveniently. There is an open funnel below the processing platform, so that waste sand enters into a waste sand collecting small cart from the funnel Provided that angle between an inclined surface of the funnel and the surface of the processing platform is larger than 30°, sand may be smoothly slide down along the inclined surface.

Preferably, movement in the Z direction is achieved by fixing the Z-shaft on the Y-shaft sliding block and moving the electric spindle on the Z-shaft sliding block in the Z direction, or is achieved by fixing the Z-shaft sliding block and the Y-shaft sliding block together, and fixing the Z-shaft and the electric spindle into one piece and moving the Z-shaft and the electric spindle in the Z direction.

Preferably, the processing cutter may be a ceramic milling cutter, a diamond milling cutter, a tipped diamond milling cutter, a surface diamond-coating milling cutter, or a surface coating carbide milling cutter. The cutter is connected with the processing spindle by a spring collet of ER series.

Preferably, the X-shaft and the Y-shaft may be driven by screw, or may be driven by synchronous belt or other devices. If the X-shaft adopts the screw transmission, the opposite sides of the machine may be provided with drive shafts, which move synchronously under control.

Compared with the traditional manufacture method, the rapid forming manufacture method and the ordinary machine milling method of casting mold in the prior art, the digital processing method and device of large or medium-size sand mold according to the present invention have the following advantages:

1. A high efficiency and a high speed are achieved. Compared with the conventional technique, in the method according to the invention, the step of manufacturing wooden mold is omitted. Compared with the rapid forming method, in the method according to the invention, a high-speed cutting may be achieved.

2. The casting mold processed has good casting performances. Compared with the rapid forming method, in the method according to the invention, the problem of excessive dense and compact partial portion in the mold caused by selectively cohering or sintering during processing is avoided.

3. Discharging the waste sand is taken into consideration sufficiently. Compared with the sand mold milling method of the ordinary machine, in the processing method according to the invention, sand is discharged through assisting by gas, and the collecting device below the hollow grid-shaped processing platform is used to collect waste sand, which the protection of movement components is taken into consideration sufficiently.

BRIEF DESCRIPTION OF THE DRAWINGS

The present invention will be further described below in conjunction with drawings and embodiments.

DETAILED DESCRIPTION

Figure 1:
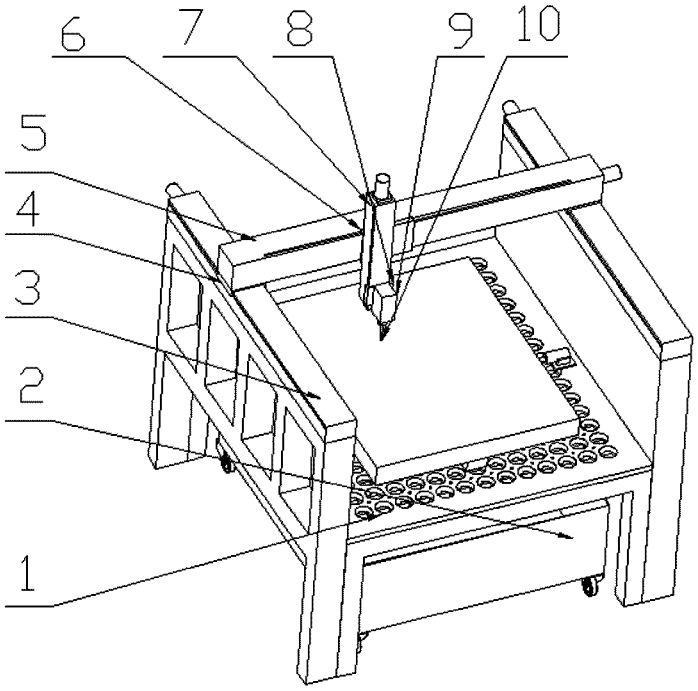
FIGS. 1 and 2 are processing schematic views of a digital processing method and a device of large or medium-size sand mold.
Figure 2:
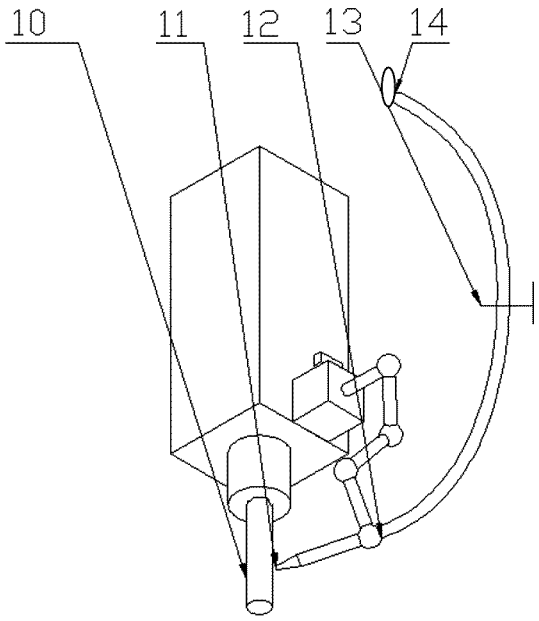
Figure 3:
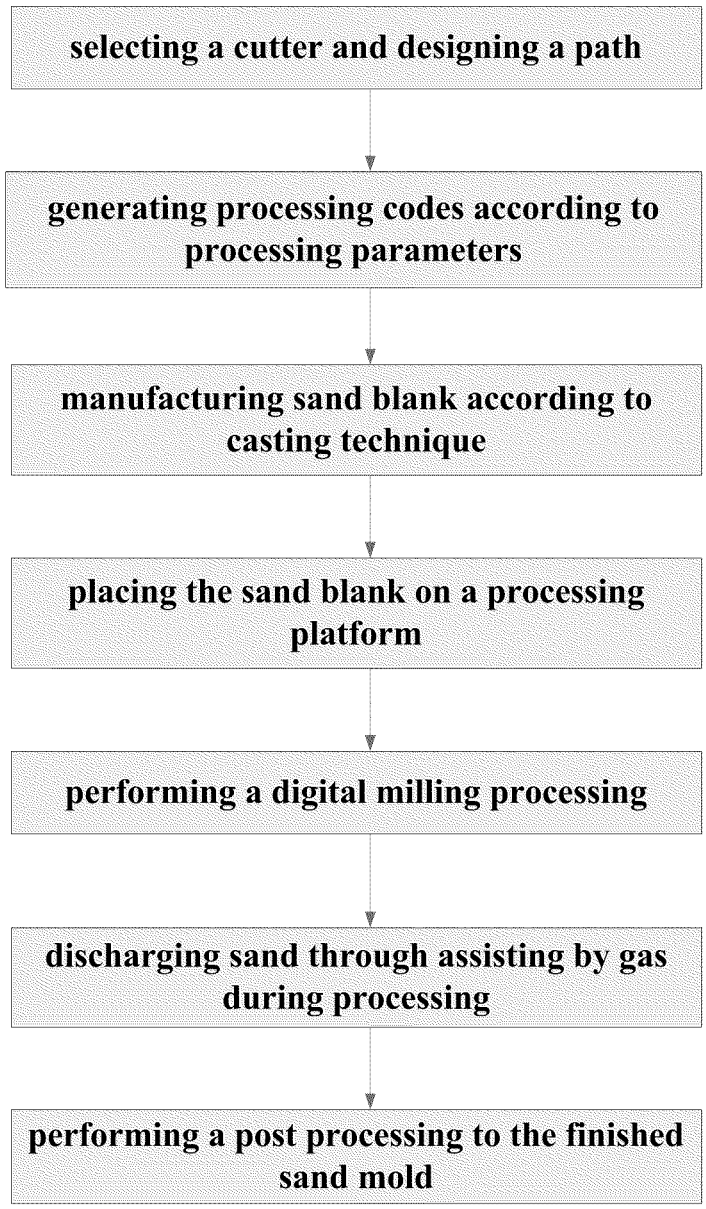
FIG. 3 is a processing flowchart of a digital processing method and a device of large or medium-size sand mold.

Hereinafter, the present invention will be described in detail with reference to FIGS. 1, 2 and 3, which is not intended to limit the present invention.

The specific steps are given as follows.

(1) According to a three-dimensional CAD model of casting mold, a processing cutter is selected and a cutter path is designed. The design of the cutter path means that the processing of large sand mold includes two procedures, i.e., rough processing and finish processing. In the rough processing, an end milling cutter having a diameter larger than 8 mm is selected to perform cutting while giving priority to layers, with a processing allowance being ranged from 0.5 mm to 2 mm and the thickness of layer being ranged from 1 mm to 4 mm. In the finish processing, a ball end cutter having a diameter less than 8 mm is selected to perform processing of contour and curved surface while giving priority to depth, with the thickness of layer being less than 0.5 mm.

(2) Processing codes acceptable to a processing device are generated according to the designed path and processing parameters. The cutter path optimization refers to delete short lines with the length less than 1-2 mm and major arcs with the distance between its end points less than 1-2 mm by combining paths according to the size of a part to be machined and an acceptable precision. The processing parameters include the rotation speed of a spindle, the cutting velocity and the cutting depth. The rotation speed of the spindle is in the range of 2000-20000 RPM (revolutions per minute). The cutting velocity is within 200 mm/s, and the cutting depth is within 10 mm.

(3) According to casting technique requirements, appropriate molding sand and binding agent are selected to manufacture a sand blank used in the numerical control processing. The sand blank may be a sand blank with box, or may be a sand blank without box, and the size of the sand blank is larger than 350×400×100 $mm^3$. According to the requirements of casting technique, the sand blank used may be resin sand, sodium silicate sand, or also may be coated sand. Taking sodium silicate sand as an example, molding sand having various mesh number, such as 50/100, 70/140, 40/70, is selected according to type and size of casting part, binding agent is ester hardening sodium silicate, and a curing agent is organic ester curing agent.

(4) The sand blank is placed on a hollow grid-shaped processing platform to proceed a digital milling processing. Specifically, depending on the weight of the sand blank and the amount of the cutting force, the sand blank may be placed on the processing platform to be processed directly, or to be processed after being fixed by a clamping tool. The force for cutting the sand mold is generally less than 100 N, so the sand blank having a weight above 20 kg may be directly placed on the platform to be processed without being clamped.

(5) Waste sand produced during processing is taken away by high-pressure gas blown out from a nozzle near the cutter, and enters into a collecting device below the processing platform through meshes of the processing platform;

(6) A post processing is performed to the finished sand mold.

The device includes a hollow grid-shaped processing platform 1, a waste sand collecting device 2 provided below the processing platform and sealed with the processing platform into one piece, a X-shaft 3 fixed above a device body, a sliding block 4 being slidable on the X-shaft 3 in the X direction, a Y-shaft 5 fixed on the X-shaft sliding block 4, a sliding block 6 being slidable on the Y-shaft 5 in the Y direction, a Z-shaft 7 fixed on the Y-shaft sliding block 6, a sliding block 8 being slidable on the Z-shaft 7 in the Z direction, an electric spindle 9 fixed on the sliding block 8, a cutter 10 clamped on the electric spindle 9, a nozzle 11 fixed on the Z-shaft 7 and disposed near the cutter head, a gas pipe 12 connected with the nozzle 11, an electromagnetic valve 13 connected with the gas pipe 12 and controlling gas to switch on/off and a gas source 14 connected with the electromagnetic valve 13 via the gas pipe. Location holes for mounting a clamping tool may be machined in the processing platform 1. There is a waste sand collecting device 2 below the processing platform 1. Small wheels may be installed below the waste sand collecting device 2, so as to discharge waste sand conveniently. There is an open funnel below the processing platform, so that waste sand enters into a waste sand collecting small cart from the funnel Provided that angle between an inclined surface of the funnel and the surface of the processing platform is larger than 30°, sand may be smoothly slide down along the inclined surface.

Specifically, the movement in the Z direction may be achieved by fixing the Z-shaft on the Y-shaft sliding block and moving the electric spindle on the Z-shaft sliding block in the Z direction, or may be achieved by fixing the Z-shaft sliding block and the Y-shaft sliding block together and fixing the Z-shaft and the electric spindle into one piece and moving the Z-shaft and the electric spindle in the Z direction.

Specifically, the processing cutter may be a ceramic milling cutter, a diamond milling cutter, a tipped diamond milling cutter, a surface diamond-coating milling cutter, or a surface coating carbide milling cutter. The cutter may be connected with the processing spindle by a spring collet of ER series.

Specifically, the X-shaft and the Y-shaft may be driven by screw, or may be driven by synchronous belt or other devices. If the X-shaft adopts the screw transmission, the opposite sides of the machine are provided with drive shafts, which move synchronously under control.

What is claimed is:

1. A digital processing method of large or medium-size sand mold, comprising the steps of:

a) selecting a processing cutter and designing a cutter path according to a three-dimensional CAD model of a casting mold;

b) deleting short lines with little distance in a processing path by a path optimization according to size and precision requirement of part to be processed;

c) generating processing codes acceptable to a processing equipment according to the designed path and processing parameters;

d) selecting appropriate molding sand and binding agent according to casting technique requirement so as to manufacture sand blank used in a numerical control processing;

e) placing the sand blank on a hollow grid-shaped processing platform to proceed a digital milling processing;

f) taking away waste sand generated during processing by high pressure gas blown out from a nozzle near a cutter head, and allowing the waste sand to enter into a collecting device below the processing platform through meshes of the processing platform; and g) performing a post processing to the finished sand mold.

2. The digital processing method of large or medium-size sand mold according to claim 1, wherein the processing parameters comprise rotation speed of a spindle, cutting velocity and cutting depth, the rotation speed of the spindle is in a range of 2000-20000 RPM, the cutting velocity is within 200 mm/s, and the cutting depth is within 10 mm.

3. The digital processing method of large or medium-size sand mold according to claim 1, wherein the sand blank is a sand blank with box or a sand blank without box.

4. The digital processing method of large or medium-size sand mold according to claim 1, wherein in the step of placing the sand blank on the hollow grid-shaped processing platform to proceed the digital milling processing, depending on to weight of the sand blank and amount of cutting force, the sand blank is placed on the processing platform to be processed directly, or to be processed after being fixed by a clamping tool.

5. A device for carrying out the method as claimed in claim 1, comprising a hollow grid-shaped processing platform (1), a waste sand collecting device (2) provided below the processing platform and sealed with the processing platform into one piece, a X-shaft (3) fixed above a device body, a sliding block (4) being slidable on the X-shaft (3) in an X direction, a Y-shaft (5) fixed on the X-shaft sliding block (4), a sliding block (6) being slidable on the Y-shaft (5) in a Y direction, a Z-shaft (7) fixed on the Y-shaft sliding block (6), a sliding block (8) being slidable on the Z-shaft (7) in a Z direction, an electric spindle (9) fixed on the sliding block (8), a cutter (10) clamped on the electric spindle (9), a nozzle (11) fixed on the Z-shaft (7) and disposed near the cutter head, a gas pipe (12) connected with the nozzle (11), an electromagnetic valve (13) connected with the gas pipe (12) and controlling gas to switch on/off and a gas source (14) connected with the electromagnetic valve via the gas pipe.

6. The device for carrying out the digital processing method of large or medium-size sand mold according to claim 5, wherein the processing platform comprises location holes for mounting a clamping tool, there is a waste sand collecting device below the processing platform, small wheels are installed on the waste sand collecting device so as to discharge the waste sand conveniently.

7. The device for carrying out the digital processing method of large or medium-size sand mold according to claim 5, wherein movement in the Z direction is achieved by fixing the Z-shaft on the Y-shaft sliding block and moving the electric spindle on the Z-shaft sliding block in the Z direction, or is achieved by fixing the Z-shaft sliding block and the Y-shaft sliding block together and fixing the Z-shaft and the electric spindle into one piece and moving the Z-shaft and the electric spindle in the Z direction.

8. The device for carrying out the digital processing method of large or medium-size sand mold according to claim 5, wherein there is a waste sand collecting device below the processing platform, and waste sand enters into the waste sand collecting device through meshes of the processing platform.

9. The device for carrying out the digital processing method of large or medium-size sand mold according to claim 5, wherein the processing cutter is a ceramic milling cutter, a diamond milling cutter, a tipped diamond milling cutter, a surface diamond-coating milling cutter, or a surface coating carbide milling cutter.

10. The device for carrying out the digital processing method of large or medium-size sand mold according to claim 5, wherein the X-shaft and the Y-shaft are driven by screw or synchronous belt.

* * * * *